US011215190B2

(12) United States Patent
Fujiwara et al.

(10) Patent No.: US 11,215,190 B2
(45) Date of Patent: Jan. 4, 2022

(54) CENTRIFUGAL COMPRESSOR

(71) Applicant: IHI Corporation, Koto-ku (JP)

(72) Inventors: Takashi Fujiwara, Tokyo (JP); Ryusuke Numakura, Tokyo (JP)

(73) Assignee: IHI Corporation, Koto-ku (JP)

( * ) Notice: Subject to any disclaimer, the term of this patent is extended or adjusted under 35 U.S.C. 154(b) by 41 days.

(21) Appl. No.: 16/703,925

(22) Filed: Dec. 5, 2019

(65) Prior Publication Data

US 2020/0109718 A1 Apr. 9, 2020

Related U.S. Application Data

(63) Continuation of application No. PCT/JP2018/024244, filed on Jun. 26, 2018.

(30) Foreign Application Priority Data

Jun. 28, 2017 (JP) ..... JP2017-126761

(51) Int. Cl.
*F04D 29/42* (2006.01)
*F04D 29/28* (2006.01)
(Continued)

(52) U.S. Cl.
CPC ..... *F04D 29/284* (2013.01); *F04D 29/464* (2013.01); *F04D 29/4213* (2013.01);
(Continued)

(58) Field of Classification Search
CPC .. F04D 29/284; F04D 29/4213; F04D 29/444; F04D 29/464; F01D 17/143;
(Continued)

(56) References Cited

U.S. PATENT DOCUMENTS 4,643,639 A 2/1987 Caine
6,648,594 B1 * 11/2003 Horner ..... F04D 27/0207 415/145
(Continued)

FOREIGN PATENT DOCUMENTS

CN 204783737 U 11/2015
CN 105626239 A 6/2016
(Continued)

OTHER PUBLICATIONS

Japanese Office Action dated Jan. 5, 2021 in Japanese Patent Application No. 2019-526947, citing document AA therein, 2 pages.
(Continued)

*Primary Examiner* — Ninh H. Nguyen
(74) *Attorney, Agent, or Firm* — Oblon, McClelland, Maier & Neustadt, L.L.P.

(57) ABSTRACT

Provided is a centrifugal compressor, including: an impeller including blades; a main flow passage including a narrowing portion, which is formed on a front side of the impeller and has a diameter smaller than a diameter of each of the blades; an auxiliary flow passage, which has one end communicating to the main flow passage on the impeller side with respect to the narrowing portion and another end communicating to the main flow passage on a side away from the impeller with respect to the narrowing portion; and a movable portion which is movable between a first position and a second position, the second position being different from the first position in position in a rotation axis direction and a rotation direction of the impeller and in opening degree of the auxiliary flow passage.

3 Claims, 9 Drawing Sheets

(51) Int. Cl.
*F04D 29/46* (2006.01)
*F04D 29/44* (2006.01)

(52) U.S. Cl.
CPC ..... *F04D 29/444* (2013.01); *F05D 2220/40* (2013.01); *F05D 2250/51* (2013.01); *F05D 2250/90* (2013.01)

(58) Field of Classification Search
CPC .. F01D 17/145; F01D 17/141; F05D 2250/40; F05D 2250/51; F05D 2250/90
See application file for complete search history.

(56) References Cited

U.S. PATENT DOCUMENTS

| | | | | |
|---|---|---|---|---|
| 8,061,974 | B2 * | 11/2011 | Gu | F04D 29/4213 415/145 |
| 8,696,299 | B2 * | 4/2014 | Bywater | F02B 37/16 415/1 |
| 9,528,527 | B2 * | 12/2016 | Sekularac | F04D 27/0215 |
| 10,167,877 | B2 * | 1/2019 | Ibaraki | F04D 29/4213 |
| 2011/0002770 | A1 | 1/2011 | Bywater et al. | |
| 2014/0308110 | A1 | 10/2014 | Houst et al. | |
| 2016/0160756 | A1 | 6/2016 | McGahey et al. | |

FOREIGN PATENT DOCUMENTS

| | | | |
|---|---|---|---|
| DE | 10 2005 027 080 | A1 | 12/2006 |
| DE | 10 2013 020 656 | A1 | 7/2014 |
| DE | 10 2013 002 192 | A1 | 8/2014 |
| JP | 6-30498 | U | 4/1994 |
| JP | 2007-255381 | A | 10/2007 |
| JP | 2010-174806 | A | 8/2010 |
| JP | 2010-190080 | A | 9/2010 |
| JP | 2011-80401 | A | 4/2011 |
| JP | 2012-177311 | A | 9/2012 |
| JP | 2014-202103 | A | 10/2014 |
| JP | 5824821 | B2 | 12/2015 |
| JP | 2016-160760 | A | 9/2016 |

OTHER PUBLICATIONS

International Search Report dated Oct. 2, 2018 in PCT/JP2018/024244 filed Jun. 26, 2018, citing documents AO and AQ-AR therein, 1 page.
Combined Chinese Office Action and Search Report dated Aug. 13, 2020 in Chinese Patent Application No. 201880042521.X, citing documents AO through AT therein, 7 pages.

* cited by examiner

CENTRIFUGAL COMPRESSOR

CROSS REFERENCE TO RELATED APPLICATIONS

This application is a continuation application of International Application No. PCT/JP2018/024244, filed on Jun. 26, 2018, which claims priority to Japanese Patent Application No. 2017-126761, filed on Jun. 28, 2017, the entire contents of which are incorporated by reference herein.

BACKGROUND ART

Technical Field

The present disclosure relates to a centrifugal compressor in which an auxiliary flow passage communicating to a main flow passage is defined.

Related Art

In some cases, a centrifugal compressor has an auxiliary flow passage communicating to a main flow passage. A compressor impeller is arranged in the main flow passage. On an upstream side of the compressor impeller in the main flow passage, a flow passage width is reduced by a narrowing portion. The auxiliary flow passage communicates to the main flow passage over the narrowing portion. The auxiliary flow passage communicates to the main flow passage through an upstream communication portion and a downstream communication portion. Further, an on-off valve is arranged in the auxiliary flow passage. In a range of a small flow rate, the on-off valve is closed. When the flow rate becomes larger, the on-off valve is opened. When the on-off valve is opened, the main flow passage communicates to the auxiliary flow passage. When the main flow passage communicates to the auxiliary flow passage, a flow-passage sectional area (effective sectional area) is increased.

In Patent Literature 1, a spherical flow passage is formed in an auxiliary flow passage. An inner peripheral surface and an outer peripheral surface of the spherical flow passage are concentric spherical surfaces. A plurality valve bodies of an on-off valve are arrayed in a circumferential direction of a rotation shaft of a compressor impeller. The plurality of valve bodies each have an arc shape conforming to the inner peripheral surface and the outer peripheral surface of the spherical flow passage. The plurality of valve bodies are supported so as to be rotatable about respective rotation shafts extending through a center of the spherical surfaces of the spherical flow passage. A plurality of rotation shafts are provided in a radial pattern so as to be capable of supporting the plurality of valve bodies. The rotation shafts rotate to cause the plurality of valve bodies to be arrayed substantially in flush with one another, thereby closing the on-off valve.

CITATION LIST

Patent Literature

Patent Literature 1: Japanese Patent NO. 5824821

SUMMARY

Technical Problem

However, in Patent Literature 1, an opening/closing mechanism configured to open and close the auxiliary flow passage is complicated. Therefore, the opening/closing mechanism configured to open and close the auxiliary flow passage causes increase in cost. Thus, there has been a demand for development of a technology for simplifying the structure of the opening/closing mechanism configured to open and close the auxiliary flow passage.

The present disclosure has an object to provide a centrifugal compressor capable of simplifying structure.

Solution to Problem

In order to solve the above-mentioned problem, according to one embodiment of the present disclosure, there is provided a centrifugal compressor, including: an impeller including blades; a main flow passage including a narrowing portion, which is formed on a front side of the impeller and has a diameter smaller than a diameter of each of the blades; an auxiliary flow passage, which has one end communicating to the main flow passage on the impeller side with respect to the narrowing portion and another end communicating to the main flow passage on a side away from the impeller with respect to the narrowing portion; and a movable portion which is movable between a first position and a second position, the second position being different from the first position in position in a rotation axis direction and a rotation direction of the impeller and in opening degree of the auxiliary flow passage.

The movable portion may be provided in the auxiliary flow passage.

In order to solve the above-mentioned problem, according to one embodiment of the present disclosure, there is provided a centrifugal compressor, including: an impeller including blades; a main flow passage including a narrowing portion, which is formed on a front side of the impeller and has a diameter smaller than a diameter of each of the blades; an auxiliary flow passage, which has one end communicating to the main flow passage on the impeller side with respect to the narrowing portion and another end communicating to the main flow passage on a side away from the impeller with respect to the narrowing portion; and a movable portion, which is provided in the auxiliary flow passage, and is movable between a first position and a second position, the second position being different from the first position in position in a rotation axis direction of the impeller and in opening degree of the auxiliary flow passage.

Effects of Disclosure

According to the present disclosure, the centrifugal compressor is capable of simplifying structure.

DESCRIPTION OF EMBODIMENT

Figure 1:
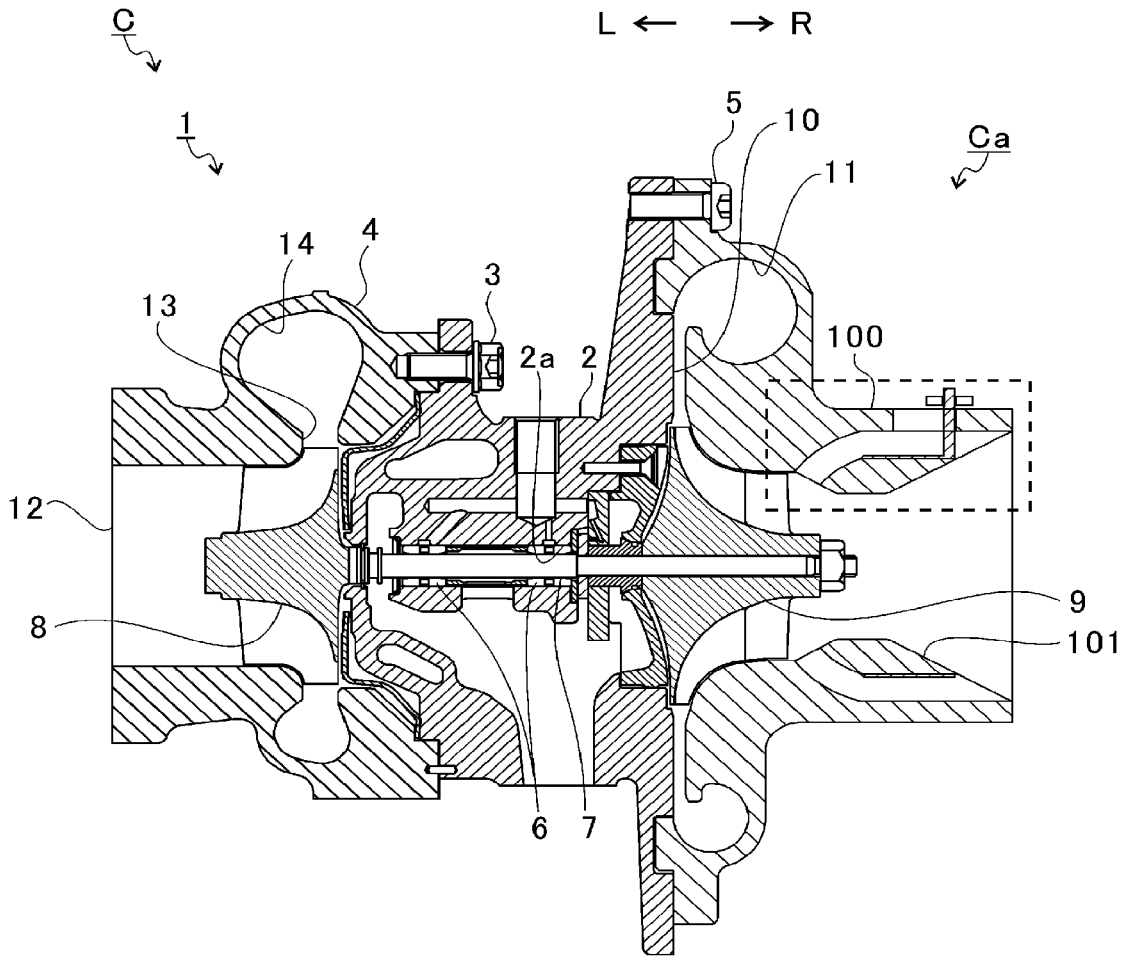
FIG. 1 is a schematic sectional view of a turbocharger.

Now, with reference to the attached drawings, an embodiment of the present disclosure is described in detail. The dimensions, materials, and other specific numerical values represented in the embodiment are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view of a turbocharger. In the following description, the direction indicated by the arrow L illustrated in FIG. 1 corresponds to a left side of the turbocharger C, and the direction indicated by the arrow R illustrated in FIG. 1 corresponds to a right side of the turbocharger C. In the turbocharger C, a compressor impeller 9 (impeller) side described later functions as a centrifugal compressor Ca. In the following, description is made of the turbocharger C as one example of the centrifugal compressor Ca. However, the centrifugal compressor Ca is not limited to the turbocharger C. The centrifugal compressor Ca may be incorporated into a device other than the turbocharger C, or may be solely provided.

As illustrated in FIG. 1, the turbocharger C includes a turbocharger main body 1. The turbocharger main body 1 includes a bearing housing 2. A turbine housing 4 is coupled to the left side of the bearing housing 2 with a fastening bolt 3. A compressor housing 100 is coupled to the right side of the bearing housing 2 with a fastening bolt 5.

The bearing housing 2 has a bearing hole 2*a*. The bearing hole 2*a* passes through the turbocharger C in a right-and-left direction. Bearings 6 are provided in the bearing hole 2*a*. In FIG. 1, full-floating bearings are illustrated as one example of the bearings 6. However, the bearings 6 may be other radial bearings such as semi-floating bearings or rolling bearings. A shaft 7 is provided inside the bearings 6. The bearings 6 are configured to axially support the shaft 7 so that the shaft 7 is freely rotatable. A turbine impeller 8 is provided at a left end portion of the shaft 7. The turbine impeller 8 is accommodated in the turbine housing 4 so as to be freely rotatable. A compressor impeller 9 is provided at a right end portion of the shaft 7. The compressor impeller 9 is accommodated in the compressor housing 100 so as to be freely rotatable.

The compressor housing 100 has a main flow passage 101. The main flow passage 101 is opened on the right side of the turbocharger C. The main flow passage 101 extends in an extending direction of a rotation axis of the compressor impeller 9 (hereinafter simply referred to as "rotation axis direction"). The main flow passage 101 is connected to an air cleaner (not shown). The compressor impeller 9 is arranged in the main flow passage 101.

As described above, under a state in which the bearing housing 2 and the compressor housing 100 are coupled to each other with the fastening bolt 5, a diffuser flow passage 10 is formed. The diffuser flow passage 10 is formed between the bearing housing 2 and the compressor housing 100. The diffuser flow passage 10 is formed by opposed surfaces of the bearing housing 2 and the compressor housing 100. The diffuser flow passage 10 has a function to increase air in pressure. The diffuser flow passage 10 is annularly formed so as to extend from an inner side toward an outer side in a radial direction of the shaft 7. The diffuser flow passage 10 communicates to the main flow passage 101 on the radially inner side.

A compressor scroll flow passage 11 is provided to the compressor housing 100. The compressor scroll flow passage 11 has an annular shape. The compressor scroll flow passage 11 is positioned, for example, on the radially outer side of the shaft 7 with respect to the diffuser flow passage 10. The compressor scroll flow passage 11 communicates to a suction port of an engine (not shown). The compressor scroll flow passage 11 communicates also with the diffuser flow passage 10. Rotation of the compressor impeller 9 causes air to be taken into the compressor housing 100 from the main flow passage 101. The air having been taken is pressurized and accelerated in a course of flowing through blades of the compressor impeller 9. The air having been pressurized and accelerated is increased in pressure in the diffuser flow passage 10 and the compressor scroll flow passage 11. The air having been increased in pressure is introduced to the suction port of an engine.

The turbine housing 4 has a discharge port 12. The discharge port 12 is opened on the left side of the turbocharger C. The discharge port 12 is connected to an exhaust gas purification device (not shown). Moreover, a flow passage 13 and a turbine scroll flow passage 14 are defined in the turbine housing 4. The turbine scroll flow passage 14 has an annular shape. The turbine scroll flow passage 14 is located, for example, on an outer side with respect to the flow passage 13 in a radial direction of the turbine impeller 8. The turbine scroll flow passage 14 communicates to a gas inflow port (not shown). Exhaust gas to be discharged from a discharge manifold (not shown) of the engine is introduced to the gas inflow port. The gas inflow port communicates also to the flow passage 13. The exhaust gas having been introduced from the gas inflow port to the turbine scroll flow passage 14 is introduced to the discharge port 12 through the flow passage 13 and blades of the turbine impeller 8. The exhaust gas having been introduced to the discharge port 12 causes the turbine impeller 8 to rotate in a course of flow.

A rotation force of the turbine impeller 8 is transmitted to the compressor impeller 9 via the shaft 7. The air is increased in pressure by the rotation force of the compressor impeller 9 and is introduced to the suction port of the engine.

Figure 2A:
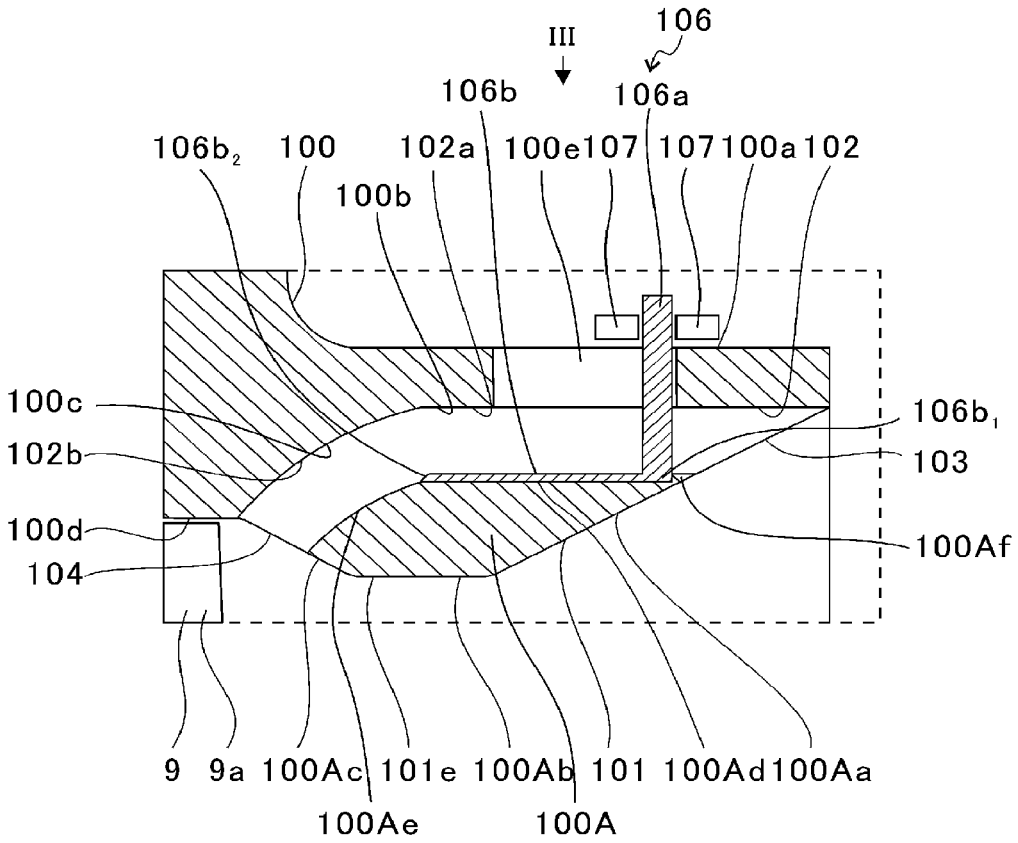
FIG. 2A is an illustration of a state in which a movable member is located at an opening position for opening an auxiliary flow passage.
Figure 2B:
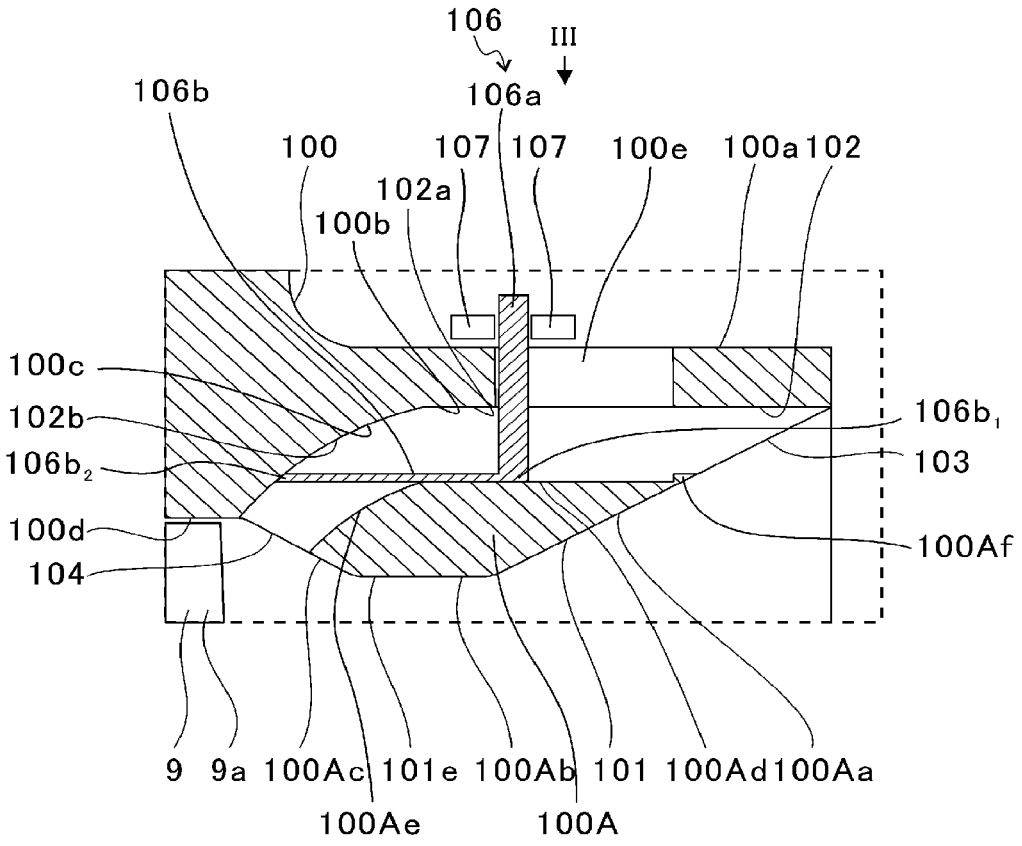
FIG. 2B is an illustration of a state in which the movable member is located at a closing position for closing the auxiliary flow passage.

FIG. 2A is an extraction view for illustrating a broken-line portion of FIG. 1. FIG. 2A is an illustration of a state in which a movable member 106 is located at an opening position for opening an auxiliary flow passage 102. FIG. 2B is an extraction view for illustrating the broken-line portion of FIG. 1. FIG. 2B is an illustration of a state in which the movable member 106 is located at a closing position for closing the auxiliary flow passage 102. As illustrated in FIG. 2A, the compressor housing 100 includes a cylindrical portion 100*a*. A narrowing portion 100A is formed inside the cylindrical portion 100*a*. The narrowing portion 100A is formed on an upstream side (front side) of the compressor impeller 9 in the rotation axis direction. The narrowing portion 100A is formed inside the cylindrical portion 100*a* through intermediation of ribs (not shown). Through the formation of the narrowing portion 100A, spreading of a back flow phenomenon, which occurs under a small pressure ratio and a small flow rate, to the upstream side can be suppressed. As a result, an operation range of the centrifugal compressor Ca can be increased.

In this embodiment, the narrowing portion 100A is formed integrally with the compressor housing 100. However, the narrowing portion 100A may be formed separately from the compressor housing 100. In such a case, the narrowing portion 100A may be mounted to the compressor housing 100. The narrowing portion 100A divides the flow passage on the upstream side of the compressor impeller 9 into the main flow passage 101 and the auxiliary flow passage 102 (bypass flow passage). An inner peripheral surface of the narrowing portion 100A has a radially contracted portion 100Aa, an upstream parallel portion 100Ab, and a radially expanded portion 100Ac.

Moreover, an outer peripheral surface of the narrowing portion 100A has a parallel portion 100Ad and a curved surface portion 100Ae. Further, in this embodiment, the narrowing portion 100A includes a step portion 100Af between the parallel portion 100Ad and the radially contracted portion 100Aa. The step portion 100Af includes an upper surface parallel to the rotation axis direction and a side surface orthogonal to the rotation axis direction. The upper surface of the step portion 100Af is formed so as to be continuous with the radially contracted portion 100Aa. The side surface of the step portion 100Af is formed so as to be continuous with the upper surface of the step portion 100Af and the parallel portion 100Ad. An inner peripheral surface of the cylindrical portion 100*a* has a parallel portion 100*b*, a curved surface portion 100*c*, and a downstream parallel portion 100*d*.

The radially contracted portion 100Aa is reduced in inner diameter toward the compressor impeller 9 side. The radially contracted portion 100Aa forms an opening end of the auxiliary flow passage 102 on an inner peripheral side. The upstream parallel portion 100Ab is parallel to the rotation axis direction. The upstream parallel portion 100Ab is continuous from the radially contracted portion 100Aa toward the compressor impeller 9 side. The radially expanded portion 100Ac is increased in inner diameter toward the compressor impeller 9 side. The radially expanded portion 100Ac is continuous from the upstream parallel portion 100Ab toward the compressor impeller 9 side.

The parallel portion 100Ad is parallel to the rotation axis direction. The curved surface portion 100Ae is reduced in outer diameter toward the compressor impeller 9 side. The curved surface portion 100Ae is continuous from the parallel portion 100Ad toward the compressor impeller 9 side.

The parallel portion 100*b* is parallel to the rotation axis direction. The parallel portion 100*b* is opened at an end surface of the cylindrical portion 100*a* of the compressor housing 100. The parallel portion 100*b* forms an opening end of the auxiliary flow passage 102 on an outer peripheral side. The curved surface portion 100*c* is reduced in inner diameter toward the compressor impeller 9 side. The curved surface portion 100*c* is continuous from the parallel portion 100*b* toward the compressor impeller 9 side. The downstream parallel portion 100*d* is parallel to the rotation axis direction. The downstream parallel portion 100*d* is continuous from the curved surface portion 100*c* toward the compressor impeller 9 side.

The radially contracted portion 100Aa, the upstream parallel portion 100Ab, the radially expanded portion 100Ac, the parallel portion 100Ad, the curved surface portion 100Ae, the parallel portion 100*b*, and the curved surface portion 100*c* are located on an upstream side with respect to blades 9*a* of the compressor impeller 9. The blades 9*a* of the compressor impeller 9 are arranged on an inner side of the downstream parallel portion 100*d*.

A diameter of the upstream parallel portion 100Ab is smaller than a diameter of the downstream parallel portion 100*d*. That is, a distance from a rotation center axis of the compressor impeller 9 to the upstream parallel portion 100Ab is smaller than a distance from the rotation center axis of the compressor impeller 9 to the downstream parallel portion 100*d*. Moreover, a diameter of a front edge of each of the blades 9*a* of the compressor impeller 9 arranged on the inner side of the downstream parallel portion 100*d* is smaller than the diameter of the downstream parallel portion 100*d*. Moreover, the diameter of the upstream parallel portion 100Ab is smaller than the diameter of the front edge of each of the blades 9*a* of the compressor impeller 9. The upstream parallel portion 100Ab may be omitted, and the radially contracted portion 100Aa and the radially expanded portion 100Ac may be continuous with each other. In such a case, it is preferred that a diameter of a portion at which the radially contracted portion 100Aa and the radially expanded portion 100Ac are continuous with each other be smaller than the diameter of the front edge of each of the blades 9*a* of the compressor impeller 9.

The main flow passage 101 has a narrowing portion (narrowed flow passage) 101*e* which is formed by the radially contracted portion 100Aa, the upstream parallel portion 100Ab, and the radially expanded portion 100Ac. A flow-passage sectional area of the main flow passage 101 is reduced by the narrowing portion 100A.

The auxiliary flow passage 102 is formed between the cylindrical portion 100*a* and the narrowing portion 100A of the compressor housing 100. The auxiliary flow passage 102 is formed on a radially outer side of the main flow passage 101. The auxiliary flow passage 102 extends in a rotation direction of the compressor impeller 9 (hereinafter simply referred to as "rotation direction" and corresponding to a circumferential direction of the shaft 7 and a circumferential direction of the narrowing portion 100A). The auxiliary flow passage 102 includes a parallel flow passage portion 102*a* and an impeller-side flow passage portion 102*b*. The parallel flow passage portion 102*a* is formed between the parallel portion 100*b* and the parallel portion 100Ad. The impeller-side flow passage portion 102*b* is formed between the curved surface portion 100*c* and the curved surface portion 100Ae. An inner wall surface of the parallel portion 100*b* extends in the rotation axis direction.

The impeller-side flow passage portion 102*b* extends toward the radially inner side as approaching the compressor impeller 9. A sectional shape of the impeller-side flow passage portion 102*b* along a cross section including the rotation axis of the compressor impeller 9 (hereinafter simply referred to as "rotation axis") is curved. That is, the curved surface portion 100*c* and the curved surface portion 100Ae each have a curved shape. The impeller-side flow passage portion 102*b* has a curved shape. A curvature center of the impeller-side flow passage portion 102*b* is located on the radially inner side (lower right side in FIG. 2A) with respect to the impeller-side flow passage portion 102*b*.

However, the curvature center of the impeller-side flow passage portion 102*b* may be located on the radially outer side (upper left side in FIG. 2A) with respect to the impeller-side flow passage portion 102*b*. Moreover, a sectional shape of the impeller-side flow passage portion 102*b* parallel to the rotation axis may be a non-spherical shape or a straight-line shape. When the impeller-side flow passage portion 102*b* (curved surface portion 100*c* and curved surface portion 100Ae) has the spherical shape, there is a risk in that a flow of air flowing inside the impeller-side flow passage portion 102*b* interferes with a flow of air flowing inside the main flow passage 101.

In such a case, it is more preferred that the impeller-side flow passage portion 102*b* have an outlet shape extending along the main flow passage 101, that is, a shape close to a straight line extending in the rotation axis direction of the compressor impeller 9. Moreover, it is preferred that a cavity formed so as to extend from a lower surface of the opening/closing portion 106*b* on the downstream side of the auxiliary flow passage 102 under a state in which the auxiliary flow passage 102 is closed by an opening/closing portion 106*b* described later be formed small. Therefore, it is more preferred that the impeller-side flow passage portion 102*b* (curved surface portion 100*c* and curved surface portion 100Ae) be formed into a straight-line shape having a curvature radius larger than that of the spherical shape.

The auxiliary flow passage 102 communicates to the main flow passage 101 through an upstream communication portion 103 and a downstream communication portion 104. The upstream communication portion 103 and the downstream communication portion 104 are opening portions which are open to the main flow passage 101. The upstream communication portion 103 is opened between the radially contracted portion 100Aa and the parallel flow passage portion 102*a*. The downstream communication portion 104 is opened between the radially expanded portion 100Ac and the impeller-side flow passage portion 102*b*. The downstream communication portion 104 is opened on the upstream side with respect to the compressor impeller 9 in the main flow passage 101.

The downstream communication portion 104 is located on the compressor impeller 9 side with respect to the upstream communication portion 103. The downstream communication portion 104 allows the main flow passage 101 and the auxiliary flow passage 102 to communicate to each other on the side closer to the compressor impeller 9 with respect to the narrowing portion 101*e*. The upstream communication portion 103 allows the main flow passage 101 and the auxiliary flow passage 102 to communicate to each other on the side farther from the compressor impeller 9 with respect to the narrowing portion 101*e*. That is, the auxiliary flow passage 102 includes the downstream communication portion 104 at one end thereof, which communicates to the main flow passage 101 on the compressor impeller 9 side with respect to the narrowing portion 101*e*, and the upstream communication portion 103 at another end thereof, which communicates to the main flow passage 101 on the side farther from the compressor impeller 9 with respect to the narrowing portion 101*e*.

In the auxiliary flow passage 102, the movable member 106 is provided so as to be movable in the rotation axis direction of the compressor impeller 9. The movable member 106 includes an engagement portion 106*a* and the opening/closing portion 106*b*. The engagement portion 106*a* is engaged with an arm 107 of an actuator (not shown). The opening/closing portion 106*b* is configured to open and close the auxiliary flow passage 102. The opening/closing portion 106*b* is formed of an annular plate-shaped member, and is arranged on the parallel portion 100Ad. The engagement portion 106*a* is formed of, for example, a columnar rod member. However, the engagement portion 106*a* may be formed of, for example, an elliptic columnar rod member or a conical rod member. The engagement portion 106*a* is provided at an end portion 106*b*1 of the opening/closing portion 106*b* on a side away from the compressor impeller 9. However, the engagement portion 106*a* may be provided at a position on the compressor impeller 9 side with respect to the end portion 106*b*1 of the opening/closing portion 106*b*.

As illustrated in FIG. 2A, the side surface of the step portion 100Af is held in abutment against the end portion $\mathbf{106}b_1$ of the opening/closing portion 106*b* when the opening/closing portion 106*b* is located at the opening position for opening the auxiliary flow passage 102. The end portion $\mathbf{106}b_1$ is, for example, a part of the opening/closing portion 106*b* which is farthest from the compressor impeller 9. When the opening/closing portion 106*b* is located at the opening position for opening the auxiliary flow passage 102, the end portion $\mathbf{106}b_2$ of the opening/closing portion 106*b* is located at a boundary portion between the parallel portion 100Ad and the curved surface portion 100Ae. The end portion $\mathbf{106}b_2$ of the opening/closing portion 106*b* is located on the parallel portion 100Ad. The end portion $\mathbf{106}b_2$ is, for example, a part of the opening/closing portion 106*b* which is closest to the compressor impeller 9. However, the end portion 106*b*2 of the opening/closing portion 106*b* may be located in the impeller-side flow passage portion 102*b* rather than on the parallel portion 100Ad.

The upper surface of the step portion 100Af has the same height as that of an upper surface of the opening/closing portion 106*b*, and forms a surface in flush with the upper surface of the opening/closing portion 106*b*. The term "same" (equal) includes the case of being completely the same (equal) and the case of deviating within a range of tolerance (processing accuracy or assembly tolerance). However, the upper surface of the step portion 100Af may have a height different from that of the upper surface of the opening/closing portion 106*b*. For example, one end of the upper surface of the step portion 100Af (end on the compressor impeller 9 side) may have the same height as that of the upper surface of the opening/closing portion 106*b*, and another end of the upper surface of the step portion 100Af (end on a side opposite to the one end) may have a height lower than the height of the upper surface of the opening/closing portion 106*b*. That is, the upper surface of the step portion 100Af may vary in height from one end to another end. Moreover, the parallel portion 100Ad and the radially contracted portion 100Aa may be continuous with each other without the step portion 100Af. In such a case, the end portion 106*b*1 of the opening/closing portion 106*b* is not brought into abutment against the side surface of the step portion 100Af, and hence the end surface which is farthest from the compressor impeller 9 may have a shape different from a planar shape. For example, the end surface of the end portion 106*b*1 of the opening/closing portion 106*b* may have a curved shape.

The end surface of the end portion 106*b*2 of the opening/closing portion 106*b* has a curved shape. As illustrated in FIG. 2B, the end portion 106*b*2 of the opening/closing portion 106*b* is held in abutment against the curved surface portion 100*c* when the opening/closing portion 106*b* is located at the closing position for closing the auxiliary flow passage 102. The end surface of the end portion 106*b*2 of the opening/closing portion 106*b* has the same shape as the curved shape of a part of the curved surface portion 100*c* which is brought into abutment against the opening/closing portion 106*b*. Thus, the opening/closing portion 106*b* is capable of closing the auxiliary flow passage 102 when the opening/closing portion 106*b* is located at the closing position illustrated in FIG. 2B. However, the end surface of the end portion 106*b*2 of the opening/closing portion 106*b* may have a shape different from the curved shape of the abutment portion of the curved surface portion 100*c*. Moreover, the end surface of the end portion 106*b*2 of the opening/closing portion 106*b* may have a planar shape rather than the curved shape.

Moreover, it is not always required that the end portion 106*b*2 of the opening/closing portion 106*b* be brought into abutment against the curved surface portion 100*c*. That is, the end portion 106*b*2 of the opening/closing portion 106*b* may enter the impeller-side flow passage portion 102*b* from the position illustrated in FIG. 2A and stop at a position before being brought into abutment against the curved surface portion 100*c*. It is only required that the movable member 106 be movable at least between the opening position (first position) for opening the auxiliary flow passage 102 and the closing position (second position) for narrowing the auxiliary flow passage 102.

The cylindrical portion 100*a* of the compressor housing 100 has a through hole 100*e* passing therethrough in the radial direction. The engagement portion 106*a* extends from the opening/closing portion 106*b* toward the radially outer side. The engagement portion 106*a* passes through the through hole 100*e* from the inside of the auxiliary flow passage 102 and extends to an outer side (radially outer side) of the through hole 100*e*. The engagement portion 106*a* is engaged with the arm 107 on the radially outer side with respect to the through hole 100*e*. The through hole 100*e* has a width in the rotation axis direction larger than a width of the engagement portion 106*a*. Specifically, the width of the through hole 100*e* in the rotation axis direction (longitudinal direction) is a width which is slightly larger than a distance (width) by which the opening/closing portion 106*b* of the movable member 106 moves between the opening position for opening the auxiliary flow passage 102 and the closing position for closing the auxiliary flow passage 102.

The through hole 100*e* has a width which is substantially equal to a width of the engagement portion 106*a* in the circumferential direction (transverse direction). The through hole 100*e* and the engagement portion 106*a* have a gap therebetween, which corresponds to a clearance required for allowing movement of the movable member 106 in the rotation axis direction. Thus, the width of the through hole 100*e* in the circumferential direction is slightly larger than the width of the engagement portion 106*a*. The width of the through hole 100*e* in the rotation axis direction is larger than the width of the through hole 100*e* in the circumferential direction.

A cover member may be mounted to the engagement portion 106*a*. The cover member is arranged at a position on the radially outer side of the through hole 100*e* and between the cylindrical portion 100*a* and the arm 107. The cover member covers the through hole 100*e*. The cover member has such a size that the through hole 100*e* can be covered during movement of the engagement portion 106*a* in the through hole 100*e*. The cover member is formed of an elastic member made of, for example, rubber. The cover member is held in contact with the outer peripheral surface of the cylindrical portion 100*a*. When the engagement portion 106*a* moves in the through hole 100*e*, the cover member slides on the outer peripheral surface of the cylindrical portion 100*a* along with the movement of the engagement portion 106*a*. With the cover member provided to the engagement portion 106*a*, the amount of gas passing through the auxiliary flow passage 102 and leaking to the outside through the through hole 100*e* can be reduced. However, the cover member may be arranged at a position on the radially inner side of the through hole 100*e* and between the cylindrical portion 100*a* and the opening/closing portion 106*b*. The cover member may slide on the inner peripheral surface of the cylindrical portion 100*a* along with the movement of the engagement portion 106*a*.

The engagement portion 106*a* is driven by the arm 107 to move in the through hole 100*e*. The opening/closing portion 106*b* slides on the parallel portion 100Ad along with the movement of the engagement portion 106*a*. With this action, the movable member 106 can move between the opening position for opening the auxiliary flow passage 102 and the closing position for closing the auxiliary flow passage 102. In other words, the movable member 106 is movable between the first position and the second position corresponding to an opening degree of the auxiliary flow passage 102 different from that given at the first position. Through opening and closing of the auxiliary flow passage 102, a flow rate at a limit of causing surging can be shifted to a small-flow-rate side, and a flow rate at a limit of causing choking on a large-flow-rate side can be prevented from being different from the flow rate at a limit which has been a limit of causing choking in the related art.

For example, in a range of a small flow rate, the actuator (not shown) (and the arm 107) moves the movable member 106 to the closing position. When the movable member 106 is moved to the closing position, the total amount of air flows through the main flow passage 101. Meanwhile, in a range of a large flow rate, the actuator (not shown) (and the arm 107) moves the movable member 106 to the opening position. When the movable member 106 is moved to the opening position, the air flows through both the main flow passage 101 and the auxiliary flow passage 102. That is, the movable member 106 opens the auxiliary flow passage 102 to increase the flow-passage sectional area (effective sectional area). Through the increase in flow-passage sectional area, the amount of reduction in flow-passage sectional area narrowed by the narrowing portion 100A can be alleviated. Therefore, the movable member 106 is capable of suppressing the reduction in the operation range on the large-flow-rate side by opening the auxiliary flow passage 102. Meanwhile, the movable member 106 is capable of increasing the operation range on the small-flow-rate side through reduction in flow-passage sectional area of the main flow passage 101 by the narrowing portion 100A by closing the auxiliary flow passage 102. Moreover, the movable member 106 improves compression efficiency on the small-flow-rate side by closing the auxiliary flow passage 102. The engagement portion 106*a* may be formed integrally with the opening/closing portion 106*b*, or may be mounted to the opening/closing portion 106*b* after the opening/closing portion 106*b* is installed on the parallel portion 100Ad.

Figure 3A:
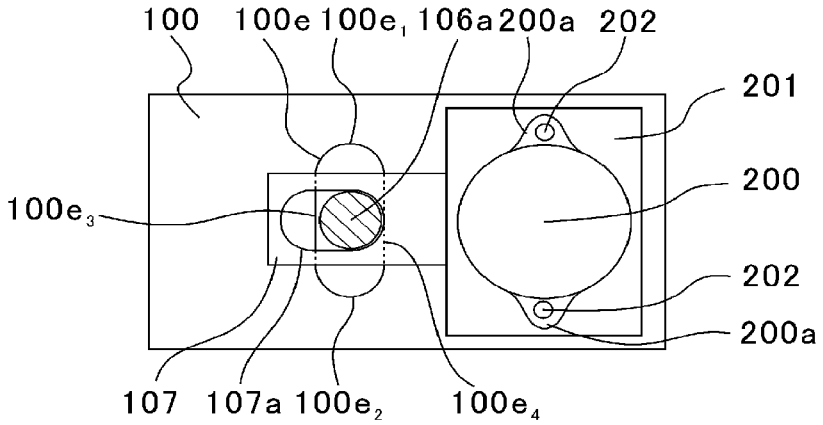
FIG. 3A is an illustration of a state in which an engagement portion is located at a center of a through hole.
Figure 3B:
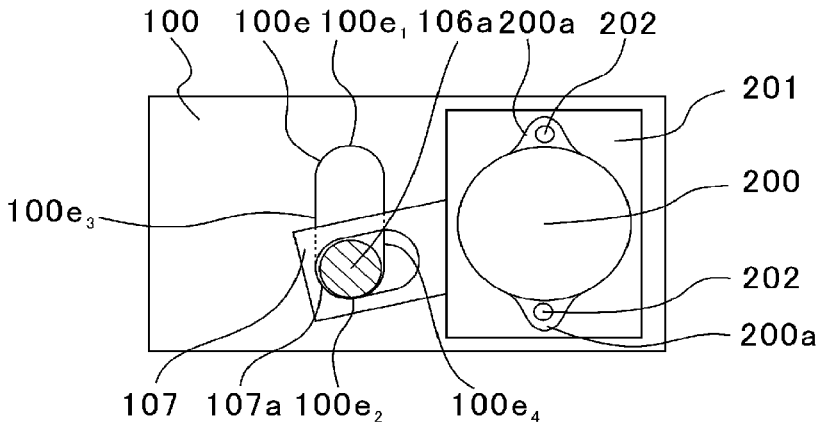
FIG. 3B is an illustration of a state in which the engagement portion has moved to a lower end portion of the through hole through rotation of an actuator in a counterclockwise direction.
Figure 3C:
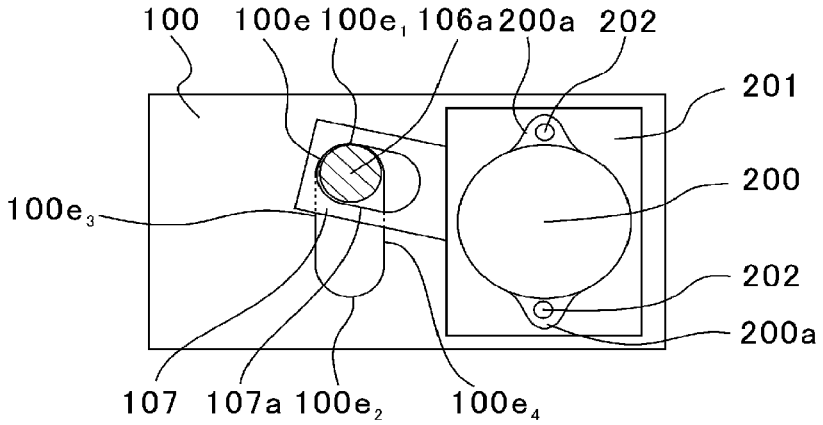
FIG. 3C is an illustration of a state in which the engagement portion has moved to an upper end portion of the through hole through rotation of the actuator in a clockwise direction.

FIG. 3A, FIG. 3B, and FIG. 3C are views for illustrating the compressor housing 100 illustrated in FIG. 2A and FIG. 2B as seen from the direction indicated by the arrow III. FIG. 3A is an illustration of a state in which the engagement portion 106*a* is located at a center of the through hole 100*e*. FIG. 3A is an illustration of a state in which the movable member 106 is located at an intermediate position between the states of FIG. 2A and FIG. 2B. FIG. 3B is an illustration of a state in which the engagement portion 106*a* has moved to a lower end portion 100*e*2 of the through hole 100*e* through rotation of an actuator 200 in a counterclockwise direction. FIG. 3B is an illustration of a state in which the movable member 106 illustrated in FIG. 2A is located at the opening position (first position) for opening the auxiliary flow passage 102. FIG. 3C is an illustration of a state in which the engagement portion 106*a* has moved to an upper end portion 100*e*$_1$ of the through hole 100*e* through rotation of the actuator 200 in a clockwise direction. FIG. 3C is an illustration of a state in which the movable member 106 illustrated in FIG. 2B is located at the closing position (second position) for closing the auxiliary flow passage 102.

As illustrated in FIG. 3A, a drive mechanism configured to drive the movable member 106 is mounted to an outer portion (outer peripheral surface) of the compressor housing 100. The drive mechanism includes the arm 107, the actuator 200, and a mounting member 201. The arm 107 has an engagement hole 107*a* which is engaged with the engagement portion 106*a* of the movable member 106. The arm 107 is engaged with the engagement portion 106*a* through the engagement hole 107*a*. The actuator 200 is formed of, for example, a motor and a solenoid. The arm 107 is mounted to a rotation shaft of the actuator 200. With this configuration, the arm 107 is rotatable in the circumferential direction of the rotation shaft of the actuator 200. The actuator 200 includes a pair of fastened portions 200*a*. The actuator 200 is mounted to the mounting member 201 through use of a pair of fastening members 202. The mounting member 201 is mounted on the outer peripheral surface of the compressor housing 100. The mounting member 201 is configured to hold the actuator 200.

As illustrated in FIG. 3A, the actuator 200 is located with respect to the center of the through hole 100*e* in a direction orthogonal to the longitudinal direction (rotation axis direction) of the through hole 100*e*. The through hole 100*e* includes the upper end portion 100*e*1, the lower end portion 100*e*2, an outer peripheral end portion 100*e*3, and an inner peripheral end portion 100*e*4. The arm 107 extends from the rotation shaft of the actuator 200 to the engagement portion 106*a* arranged in the through hole 100*e*. A width of the engagement hole 107*a* in the extending direction (longitudinal direction) of the arm 107 is larger than a width in the transverse direction orthogonal to the longitudinal direction of the arm 107. A width of the engagement hole 107*a* in the transverse direction is substantially equal to the width of the engagement portion 106*a*.

The engagement hole 107*a* and the engagement portion 106*a* have a gap therebetween, which corresponds to a clearance required for allowing movement of the movable member 106 in the rotation axis direction. Thus, the width of the engagement hole 107*a* in the transverse direction is slightly larger than the width of the engagement portion 106*a*. When the rotation shaft of the actuator 200 is rotated in the counterclockwise direction, the arm 107 is rotated in the counterclockwise direction.

The engagement portion 106*a* is engaged with the engagement hole 107*a* of the arm 107. Therefore, along with the rotation of the arm 107 in the counterclockwise direction, the engagement portion 106*a* is urged to rotate in the counterclockwise direction. However, the engagement portion 106*a* is engaged also with the through hole 100*e*. With the outer peripheral end portion 100*e*3 and the inner peripheral end portion 100*e*4 of the through hole 100*e* in the transverse direction, the movement of the engagement portion 106*a* in the transverse direction of the through hole 100*e* is restricted. Therefore, the engagement portion 106*a* moves downward in FIG. 3A along the longitudinal direction of the through hole 100*e* without rotating in the counterclockwise direction. On this occasion, the engagement portion 106*a* moves along the longitudinal direction of the engagement hole 107*a*.

Meanwhile, when the rotation shaft of the actuator 200 rotates in the clockwise direction, the arm 107 rotates in the clockwise direction. Along with the rotation of the arm 107 in the clockwise direction, the engagement portion 106*a* is urged to rotate in the clockwise direction. In this case, with the outer peripheral end portion 100*e*3 and the inner peripheral end portion 100*e*4, the engagement portion 106*a* moves upward in FIG. 3A along the longitudinal direction of the through hole 100*e*. On this occasion, the engagement portion 106*a* moves along the longitudinal direction of the engagement hole 107*a*.

As described above, the actuator 200 and the arm 107 (drive mechanism) which are configured to drive the movable member 106 are provided to the compressor housing 100. Through use of the actuator 200 and the arm 107, the movable member 106 can be moved between the opening position and the closing position. The actuator 200 and the arm 107 are provided at one location in the circumferential direction of the compressor impeller 9. That is, one actuator 200 and the one arm 107 are provided in the circumferential direction of the compressor impeller 9.

Moreover, the through hole 100*e* of the compressor housing 100 and the engagement portion 106*a* of the movable member 106 are provided at one location in the circumferential direction of the compressor impeller 9. That is, one through hole 100*e* and one engagement portion 106*a* are provided in the circumferential direction of the compressor impeller 9. In the related art, at least a plurality of through holes of the compressor housing and a plurality of engagement portions of movable members (valves) are provided. As a result, the drive mechanism configured to drive the plurality of engagement portions is complicated, and the opening/closing mechanism configured to open and close the auxiliary flow passage is high in cost. In contrast, the opening/closing mechanism in this embodiment is configured to move the movable member 106 in the rotation axis direction of the compressor impeller 9. Therefore, with the opening/closing mechanism in this embodiment, through driving of one engagement portion 106*a* with one drive mechanism, the movable member 106 can be moved in the rotation axis direction of the compressor impeller 9. Accordingly, the opening/closing mechanism configured to open and close the auxiliary flow passage 102 is simplified in the centrifugal compressor Ca according to this embodiment, thereby being capable of reducing manufacturing cost for the opening/closing mechanism.

Figure 4A:
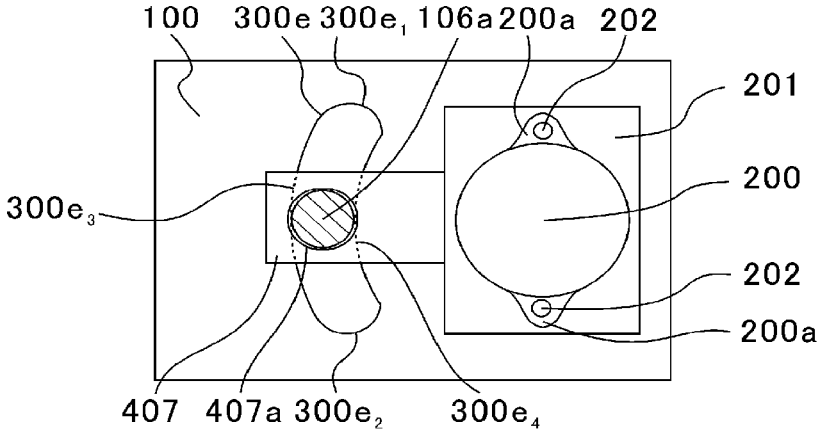
FIG. 4A is an illustration of a state in which the engagement portion is located at a center of a through hole in a first modification example.
Figure 4B:
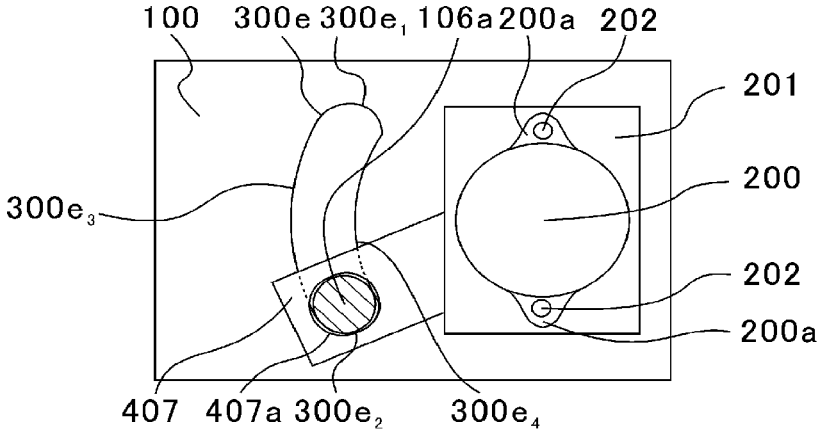
FIG. 4B is an illustration of a state in which the engagement portion has moved to a lower end portion of the through hole through rotation of the actuator in the counterclockwise direction in the first modification example.
Figure 4C:
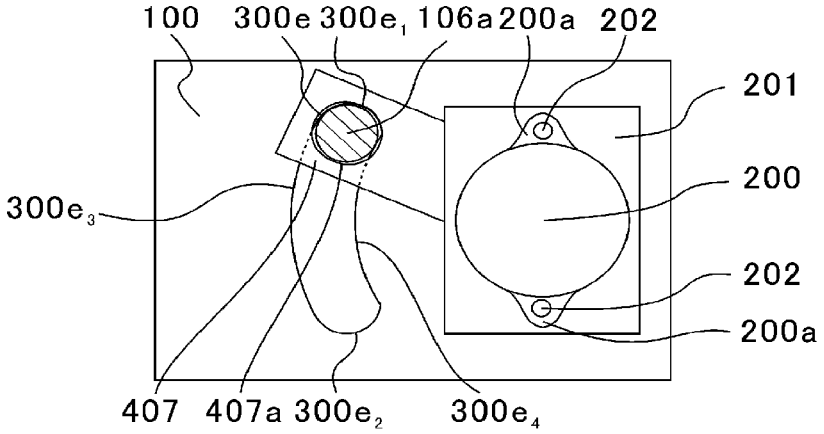
FIG. 4C is an illustration of a state in which the engagement portion has moved to an upper end portion of the through hole through rotation of the actuator in the clockwise direction in the first modification example.

FIG. 4A, FIG. 4B, and FIG. 4C are views for illustrating the compressor housing 100 illustrated in FIG. 2A and FIG. 2B as seen from the direction indicated by the arrow III in the first modification example. FIG. 4A is an illustration of a state in which the engagement portion 106*a* is located at a center of the through hole 300*e* in the first modification example. FIG. 4A is an illustration of a state in which the movable member 106 is located at an intermediate position between the states of FIG. 2A and FIG. 2B. FIG. 4B is an illustration of a state in which the engagement portion 106*a* has moved to a lower end portion 300*e*2 of the through hole 300*e* through rotation of the actuator 200 in a counterclockwise direction. FIG. 4B is an illustration of a state in which the movable member 106 illustrated in FIG. 2A is located at the opening position (first position) for opening the auxiliary flow passage 102. FIG. 4C is an illustration of a state in which the engagement portion 106*a* has moved to an upper end portion 300*e*$_1$ of the through hole 300*e* through rotation of the actuator 200 in a clockwise direction in the first modification example. FIG. 4C is an illustration of a state in which the movable member 106 illustrated in FIG. 2B is located at the closing position (second position) for closing the auxiliary flow passage 102.

As illustrated in FIG. 4A, a drive mechanism configured to drive the movable member 106 is mounted to an outer portion (outer peripheral surface) of the compressor housing 100. The drive mechanism includes an arm 407, the actuator 200, and the mounting member 201. In the embodiment described above, the compressor housing 100 has the through hole 100*e* extending in the rotation axis direction of the compressor impeller 9. In the first modification example, the compressor housing 100 has, in place of the through hole 100*e*, the through hole 300*e* extending in the circumferential direction of the rotation shaft of the actuator 200.

Moreover, in the first modification example, in place of the arm 107 having the engagement hole 107*a*, the arm 407 having an engagement hole 407*a* smaller than the engagement hole 107*a* is mounted to the rotation shaft of the actuator 200. The engagement hole 407*a* has a width which is substantially equal to a width of the engagement portion 106*a* in the longitudinal direction and the transverse direction of the arm 407. The engagement hole 407*a* and the engagement portion 106*a* have a gap therebetween, which corresponds to a clearance required for allowing movement of the movable member 106 in the rotation axis direction. Thus, the width of the engagement hole 407*a* in the longitudinal direction and the transverse direction of the arm 407 is slightly larger than the width of engagement portion 106*a*.

As illustrated in FIG. 4A, the actuator 200 is located with respect to the center of the through hole 300*e* in a direction orthogonal to the longitudinal direction (rotation axis direction) of the through hole 300*e*. The arm 407 extends from the rotation shaft of the actuator 200 to the engagement portion 106*a* arranged in the through hole 300*e*. The engagement hole 407*a* is formed so that a width thereof in the extending direction of the arm 407 and a width thereof in the direction orthogonal to the extending direction of the arm 407 are set equal to each other. However, the engagement hole 407*a* may be formed so that the width thereof in the extending direction of the arm 407 and the width thereof in the direction orthogonal to the extending direction of the arm 407 are different from each other. For example, a width of the engagement hole 407*a* in the extending direction of the arm 407 may be larger than a width in the direction orthogonal to the extending direction of the arm 407. When the rotation shaft of the actuator 200 rotates in the counterclockwise direction, the arm 407 rotates in the counterclockwise direction. The engagement portion 106*a* is engaged with the engagement hole 407*a* of the arm 407. Therefore, along with the rotation of the arm 407 in the counterclockwise direction, the engagement portion 106*a* is urged to rotate in the counterclockwise direction.

The through hole 300*e* extends in the circumferential direction of the rotation shaft of the actuator 200. The through hole 300*e* includes an upper end portion 300*e*1, a lower end portion 300*e*2, an outer peripheral end portion 300*e*3, and an inner peripheral end portion 300*e*4. Curvature centers of the outer peripheral end portion 300*e*3 and the inner peripheral end portion 300*e*4 are each set at the same position as a rotation center axis of the actuator 200. The outer peripheral end portion 300*e*3 and the inner peripheral end portion 300*e*4 are formed into concentric circular shapes. Therefore, the engagement portion 106*a* is movable in the counterclockwise direction along the outer peripheral end portion 300*e*3 and the inner peripheral end portion 300*e*4.

When the arm 407 rotates in the counterclockwise direction, the engagement portion 106*a* moves in the longitudinal direction of the through hole 300*e*, that is, moves downward in FIG. 4A along the outer peripheral end portion 300*e*3 and the inner peripheral end portion 300*e*4. Meanwhile, when the rotation shaft of the actuator 200 rotates in the clockwise direction, the arm 407 rotates in the clockwise direction. Along with the rotation of the arm 407 in the clockwise direction, the engagement portion 106*a* is urged to rotate in the clockwise direction. In this case, with the outer peripheral end portion 300*e*3 and the inner peripheral end portion 300*e*4, the engagement portion 106*a* moves upward in FIG. 4A along the longitudinal direction of the through hole 300*e*.

With such a configuration, even with the opening/closing mechanism of the first modification example, the effect similar to that of the embodiment described above can be attained. Moreover, in the first modification example, unlike the embodiment described above, the movable member 106 is moved in the rotation axis direction of the compressor impeller 9 while being rotated in the circumferential direction of the compressor impeller 9. With this configuration, the opening/closing mechanism of the first modification example is capable of more significantly moving the movable member 106 in the rotation axis direction with less (smaller) space as compared to the case in which the movable member 106 is moved in the rotation axis direction of the compressor impeller 9 without being rotated in the circumferential direction of the compressor impeller 9. Moreover, the opening/closing mechanism of the first modification example is capable of moving the movable member 106 with less (smaller) space. Therefore, in the opening/closing mechanism of the first modification example, members forming the drive mechanism can be reduced in size, thereby being capable of reducing manufacturing cost for the drive mechanism. Thus, in the centrifugal compressor Ca of the modification example, the opening/closing mechanism configured to open and close the auxiliary flow passage 102 can be formed with less space and lower cost as compared to the centrifugal compressor Ca according to the embodiment.

The one embodiment of the present disclosure has been described above with reference to the attached drawings, but, needless to say, the present disclosure is not limited to the embodiment. It is apparent that those skilled in the art may arrive at various alternations and modifications within the scope of claims, and those examples are construed as naturally falling within the technical scope of the present disclosure.

In the first modification example described above, the drive mechanism moves the movable member 106 in the rotation axis direction of the compressor impeller 9 while rotating the movable member 106 in the circumferential direction of the compressor impeller 9, to thereby bringing the auxiliary flow passage 102 into an opened state or a closed state. However, the member to be driven by the drive mechanism is not limited to the movable member 106. For example, in place of the movable member 106, the drive mechanism may move the narrowing portion 100A in the rotation axis direction of the compressor impeller 9 while rotating the narrowing portion 100A in the circumferential direction of the compressor impeller 9. That is, in place of the movable member 106 provided in the auxiliary flow passage 102, the drive mechanism may drive the narrowing portion 100A forming the auxiliary flow passage 102 as the movable portion. In this case, the engagement portion 106*a* is connected to the narrowing portion 100A. The drive mechanism drives the engagement portion 106*a* to thereby be capable of moving the narrowing portion 100A in the rotation axis direction of the compressor impeller 9 while rotating the narrowing portion 100A in the circumferential direction of the compressor impeller 9. That is, the narrowing portion 100A moves in the rotation direction and the rotation axis direction of the compressor impeller 9, to thereby be capable of bringing the auxiliary flow passage 102 into the opened state or the closed state. The drive mechanism may adopt, for example, the configuration illustrated in FIG. 4A. Through use of the configuration of the drive mechanism illustrated in FIG. 4A, the opening/closing mechanism configured to open and close the auxiliary flow passage 102 can be formed with less space and lower cost. Through use of the narrowing portion 100A as the movable portion, the number of components of the opening/closing mechanism configured to open and close the auxiliary flow passage can be further reduced, thereby being capable of further simplifying the opening/closing mechanism. However, the narrowing portion 100A has a larger weight than the movable member 106. Thus, when the narrowing portion 100A is used as the movable portion, driving with the drive mechanism may become more difficult. In such a case, when the movable member 106 is adopted as the movable portion of the opening/closing mechanism configured to open and close the auxiliary flow passage as in the first modification example, driving by the drive mechanism can be easily performed.

INDUSTRIAL APPLICABILITY

The present disclosure can be used for a centrifugal compressor having an auxiliary flow passage communicating to a main flow passage is defined.

What is claimed is:

1. A centrifugal compressor, comprising:

an impeller including blades;

a main flow passage including a narrowing portion, which is formed on a front side of the impeller and has a diameter smaller than a diameter of a front edge of each of the blades;

an auxiliary flow passage, which has one end communicating to the main flow passage on an impeller side with respect to the narrowing portion and another end communicating to the main flow passage on a side away from the impeller with respect to the narrowing portion; and a movable portion which is movable between a first position and a second position, the second position being different from the first position in position in a rotation axis direction and a rotation direction of the impeller and in opening degree of the auxiliary flow passage, wherein the auxiliary flow passage communicates with the main flow passage at a position between the impeller and the narrowing portion in the rotation axis direction.

2. The centrifugal compressor according to claim 1, wherein the movable portion is provided in the auxiliary flow passage.

3. A centrifugal compressor, comprising:

an impeller including blades;

a main flow passage including a narrowing portion, which is formed on a front side of the impeller and has a diameter smaller than a diameter of a front edge of each of the blades;

an auxiliary flow passage, which has one end communicating to the main flow passage on an impeller side with respect to the narrowing portion and another end communicating to the main flow passage on a side away from the impeller with respect to the narrowing portion; and a movable portion which is provided in the auxiliary flow passage, and is movable between a first position and a second position, the second position being different from the first position in position in a rotation axis direction of the impeller and in opening degree of the auxiliary flow passage, wherein the auxiliary flow passage communicates with the main flow passage at a position between the impeller and the narrowing portion in the rotation axis direction.

* * * * *